United States Patent [19]

Collins et al.

[11] 4,383,539

[45] May 17, 1983

[54] COSMETIC PREPARATION AND METHOD FOR APPLYING SAME

[76] Inventors: Alan L. Collins; Joseph A. Vota, both of 15 Columbus Cir., New York, N.Y. 10023

[21] Appl. No.: 157,715

[22] Filed: Jun. 9, 1980

Related U.S. Application Data

[63] Continuation of Ser. No. 926,588, Jul. 20, 1978, abandoned.

[51] Int. Cl.[2] ..... A45D 40/30

[52] U.S. Cl. ..... 132/88.5

[58] Field of Search ..... 132/88.5, 88.7, 7; 424/69, 80

[56] References Cited

U.S. PATENT DOCUMENTS

| | | | |
|---|---|---|---|
| 2,871,161 | 1/1959 | Spiegel | 424/80 X |
| 2,876,162 | 3/1959 | Lauffer | 132/88.7 |
| 2,901,100 | 8/1959 | Mueller et al. | 132/88.7 |
| 3,071,514 | 1/1963 | Phillips | 424/70 |
| 3,278,383 | 10/1966 | White | 424/69 |
| 3,341,465 | 9/1967 | Kaufman | 424/69 X |
| 3,479,434 | 11/1969 | Lange | 424/69 X |
| 3,863,654 | 2/1975 | Morane | 132/88.7 |

FOREIGN PATENT DOCUMENTS

| | | | |
|---|---|---|---|
| 2517452 | 10/1976 | Fed. Rep. of Germany | 132/88.5 |

*Primary Examiner*—G. E. McNeill

*Attorney, Agent, or Firm*—Sprung, Felfe, Horn, Lynch & Kramer

[57] ABSTRACT

A cosmetic preparation comprises a cosmetic powder implanted into a film of fixative on an area of the body by applying the fixative to the area, allowing the fixative to partially dry to form a film, applying the cosmetic powder to the partially dried fixative, and allowing the fixative to completely dry. As a result of this method of applying the cosmetic powder, the powder is maintained in position by the fixative and some particles project outwardly from the film.

5 Claims, 5 Drawing Figures

COSMETIC PREPARATION AND METHOD FOR APPLYING SAME

This is a continuation of application Ser. No. 926,588, filed July 20, 1978 now abandoned.

BACKGROUND OF THE INVENTION

The present invention relates to a cosmetic preparation and a method for applying said preparation to the body of a user, preferably in the form of a desired design.

Cosmetic preparations and methods for applying cosmetic powders are known in the prior art, but have various disadvantages associated therewith. For example, it is known to apply powder by the use of a powder puff to the face, but as a result thereof the powder does not have a good adhering quality and is thus easily removed by any type of abrasion. This poor adhering quality is exacerbated when the powder is applied to a portion of the body which is subject to constant abrasion, such as by one's clothing, since it is almost immediately rubbed off. Additionally, there is very little control over the applying of the powder to the body and it precludes the applying of the cosmetic powder in the form of a design.

Ink and dye transfers are known for applying designs to parts of the body and these transfers are extremely popular with children. However, these transfers do not have the reflective quality of a cosmetic preparation, since they are limited to inks and dyes.

It is also known that charms having designs thereon can be dipped into a bronze powder and the powder transferred onto parts of the body. This method has the disadvantage of utilizing pure metal powder, which is a non-cosmetic and thus dangerous to the user and the fact that there is no fixing of the powder to the body, so that it will only remain thereon for less than an hour where there is even the slightest degree of abrasion. On parts of the body where there is a great deal of abrasion, the powder would not remain on the body for any appreciable amount of time.

Lastly, it is known to use a pre-mixed cosmetic preparation of water-based cosmetics with Carboset TM resins, which can be used for leg make-ups, body paints, nail polishes, eye liners, etc. The disadvantage of the pre-mixed cosmetic and resin is that it does not preserve the reflective properties of a large percentage of the inorganic base cosmetic powder therein and thus it does not look as though it was placed on the skin without a fixative. This results from the fact that the film is forming and drying with the powder particles already in the resin, thus a large number of the powder particles are completely immersed in the resin and upon drying on the skin, a film of resin will be the topmost layer and thus be closest to any light source. The primary reflection will therefore be from the resin and not the powder.

SUMMARY OF THE INVENTION

The main object of the present invention is to eliminate the disadvantages of the prior art and to provide a method for applying a cosmetic powder to the body which preserves the reflective properties of the powder and looks as though it was placed on the skin without a fixative and yet resists abrasion.

Another object of the present invention is to provide a method for applying a cosmetic powder to the body which lends itself to application in the form of a desired design.

Another object of the present invention is to provide a cosmetic preparation which fixes to the body to resist abrasion and wherein the powder of the cosmetic preparation preserves its reflective properties and looks as though it was placed on the skin without a fixative.

The method of the present invention is achieved by the steps of applying a quantity of liquid or gel fixative to the area on the body which is to receive the cosmetic, allowing the fixative to partially dry to form a film on the body, applying a cosmetic powder to the partially dried fixative to implant the powder in the film with some particles projecting outwardly therefrom and thus exposed to direct sources of light and allowing the fixative to completely dry. While some particles will be immersed in the fixative, a much larger percentage of the particles will be close to the surface of the film thus increasing the amount of primary reflection from the particles and giving the desired appearance.

The step of applying the powder may advantageously be carried out by providing an imprinting applicator having a planar contact surface in the form of a given design, contacting the cosmetic powder to the contact surface of the applicator to adhere a layer of powder thereon and contacting the contact surface of the applicator with the layer of powder thereon to the partially dry fixative to implant the powder in the film in the form of the given design.

The fixative is advantageously applied by dropping at least one individual droplet or dabbing on some gel with one's finger onto the desired area of the body and spreading the fixative to encompass the total area to which the cosmetic is to be applied.

The cosmetic preparation according to the present invention includes a cosmetic powder implanted into a film of fixative on an area of the body by applying the fixative to the area, allowing the fixative to partially dry to form a soft, penetrable film, applying the cosmetic powder to the partially dried fixative and allowing the fixative to completely dry, wherein the powder is maintained in position by the fixative and some particles project outwardly from the film thus exposing portions thereof to direct sources of light.

The fixative, preferably comprises water, resin, fragrance, a bacteriostat and a dye.

These and other objects of the invention will become apparent from the following specification when read in connection with the accompanying drawing.

DETAILED DESCRIPTION OF THE INVENTION

Figure 1B:
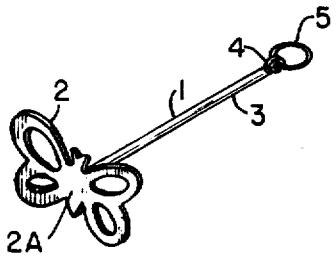
FIGS. 1A–C are diagrammatic views of the various elements of the method and cosmetic preparation of the invention.
Figure 1A:
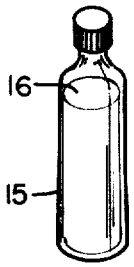
Figure 1C:
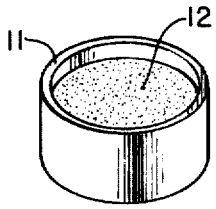
Figure 2:
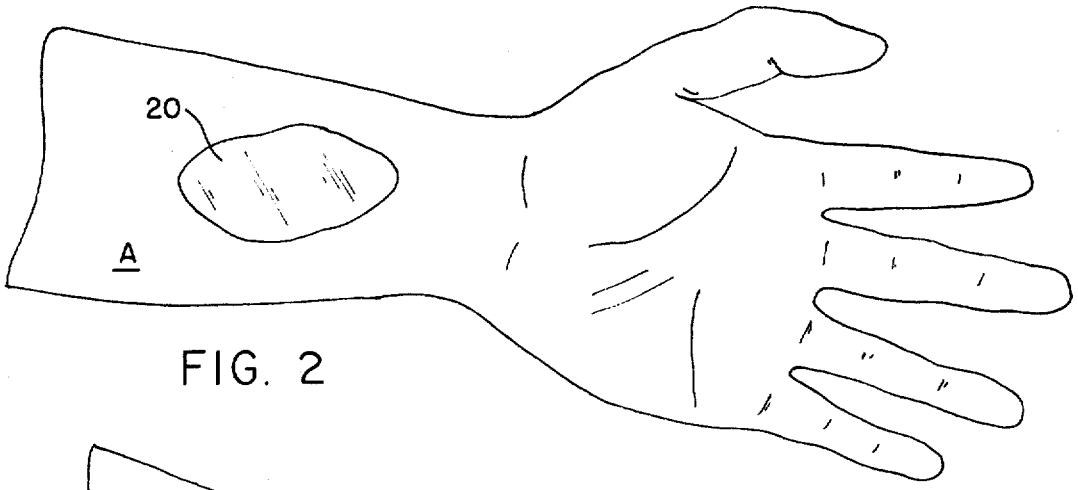
FIG. 2 is a diagrammatic view of the one step in the method of the present invention.
Figure 3:
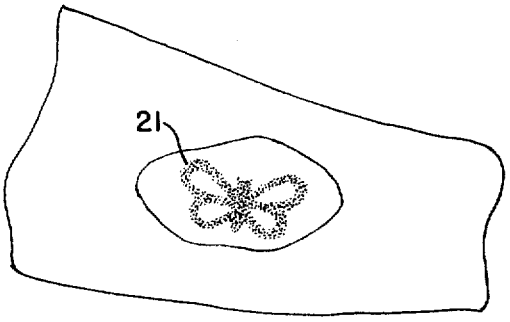
FIG. 3 is a diagrammatic view of a further step in the method of the present invention.

Referring now to FIGS. 1A–C, 2 and 3, the present invention includes an imprinting applicator 1 having a head portion 2 with a planar contacting surface 2*a* in the form of a given design. The design shown in FIG. 1B is that of a butterfly, but the design may be any two-dimensional design which is desired by the user.

Handle 3 is connected at one end to the other side of head 2 and has a loop 4 at the other end thereof which can receive a chain-loop 5 so that the imprinting applicator 1 can be worn on a chain around the user's neck, if desired.

The cosmetic powder 12 is preferably held in a container 11 which can be sealed by a cover (not shown). The fixative 16 when in liquid form, is preferably held in a small bottle 15 which allows a controlled output of the fixative therefrom such as in the form of individual droplets. When in gel form, the fixative is preferably held in a pot such as container 11 or in a tube.

During use, the fixative 15 is applied to a portion of the body, such as arm A. The liquid fixative may be brushed on by a brush applicator or individual droplets may be applied to the arm A and spread with one's finger to encompass an area on which the cosmetic design is to be imprinted. The gel fixative can be applied by one's finger from a pot or by applying the gel from a tube and then spreading with one's finger.

The fixative is allowed to partially dry to form a partially dry film 20. The time for the partial drying is dependent upon the amount and type of fixative used and in most cases the partial drying will occur within one minute, preferably less than 30 seconds.

The contact surface 2A of the applicator 1 is then contacted with the cosmetic powder 12 so that a layer of the cosmetic powder forms on the surface 2A by adhesion.

The applicator 1 with the layer of powder 12 on surface 2A is then contacted to the film 20 such that the cosmetic powder is transferred to the film 20 in the form of a cosmetic design 21.

The purpose of allowing the fixative to partially dry is threefold, to insure that the powder will be "pulled off" the applicator, to maintain the definition of the implanted design and to enable particles to project outwardly from the film and be exposed to direct sources of light. If the fixative film is too wet, the surface tension thereof will be relatively low and there is a chance that fixative will be drawn from the body to the applicator due to the adhesion of the fixative to the contact surface of the applicator. Allowing the fixative to partially dry enables it to become tacky and in effect it pulls the powder off from the contact surface of the applicator.

Additionally, if the applied fixative is too wet and the powder is implanted therein in the form of a design, there will be eddy currents in the liquid fixative which will shift the powder particles around and change the design or destroy its definition.

Finally, due to the fact that the film is partially dry, many particles will not be completely immersed in the fixative, with the result that some of the particles will have portions projecting outwardly of the film and exposed to direct sources of light. Thus the reflective properties of the powder are maintained and the design 21 looks as though it was placed on the skin without a fixative.

The fixative holds the cosmetic design 21 to the skin so that the design will remain thereon for approximately 24 hours, even where there is some abrasion. The fixative and the cosmetic design can be removed by wet rag abrasion or soap and water.

The liquid fixative formulation preferably includes an acrylic copolymer resin for providing the fixative set, a plasticizer for giving the resin a homogenous consistency, a bacteriostat for preventing infection due to bacteria, and a fragrance in order to give the fixative an agreeable odor. The remainder of the fixative is water and it may also preferably include a dye. The dye is useful since the resin has a murky color and the dye gives the fixative a more attractive tint which is imperceptible when applied to the skin.

The fixative may include anywhere from 6 to 30% by weight of resin, the plasticizer can be from 1-5% by weight, depending upon the amount of resin used. An effective amount of bacteriostat, which is greater than 0.1% should be used and the ratio of the amount of fragrance to emulsifying agent therefor is about 1:2 with an effective amount of fragrance being anything from 0.1 to 0.3% by weight. Only a small amount of dye is necessary and an effective amount can be anything greater than 0.27% by weight. The remainder of the weight of the solution is water.

EXAMPLE 1

A liquid fixative which has been found to be effective is as follows:

| Component | % by weight |
|---|---|
| Water | 84.65 |
| Acrylic/Acrylate Copolymer Resin (Carboset TM 514H) - 40% dispersion in Ammonia Water | 12.50 |
| Glycerin (plasticizer) | 2.00 |
| Polysorbate-20 (emulsifying agent for the fragrance) (Tween 20) | 0.40 |
| Quaternium-15 (Bacteriostat) (Dorvicil-200) | 0.20 |
| Fragrance (F-68-617-Perry) | 0.20 |
| D & C Green No. 5 (Dye) | 0.05 |
| | 100.00 |

The fixative was prepared by adding the following, in the above amounts, to the water: first glycerin and quaternium with heat to effect dispersion and then Carboset TM, polysorbate, fragrance, and D & C Green No. 5.

The gel fixative foundation is similar to that of the liquid fixative since it includes the common components of water, an acrylic copolymer resin, a fragrance, a bacteriostat and a dye. In order to obtain a gel, the fixative also includes a film forming agent and a neutralizer therefor which react with the water to form a gel. Additionally a humectant is added as a lubricant for easy application of the gel and as a preservative.

EXAMPLE 2

A gel fixative which has been found to be effective is as follows:

| Component | % by weight |
|---|---|
| Water | 83.134 |
| Acrylic/Acrylate Copolymer Resin (Carboset TM) | 10.00 |
| Propylene Glycol (humectant) | 5.00 |
| Triethanolamine (Neutralizer for Carbomer) | 0.65 |
| Carbomer-940 (film forming agent) | 0.5 |
| Fragrance (F-68-617-Perry) | 0.5 |
| Methyl Paraben (preservative-bacteriostat) | 0.2 |
| F. D. & C. Blue #1 (Dye) | 0.016 |
| | 100.00 |

The fixative was prepared by adding the following, in the above amounts, to the water: first propylene glycol, methyl paraben and Carbomer-940 are added with heat to effect a good dispersion, then triethanolamine is added to form the gel and then the Carboset TM, F. D. and C. Blue #1 and fragrance are added.

It has been found that the powders that best operate in the method of the invention and in the cosmetic preparation of the invention, are those having flat particles, i.e. about 1 μm in thickness, with a length from about 5 to 50 μm, preferably about 10 to 35 μm. The size and shape of these particles are the most suitable for effecting the initial adhesion to the contact surface and gives the powders a smear resistant quality. Too small a particle will not adhere to the applicator and will easily smear, while too large a particle will also be difficult to adhere to the applicator because of its weight. Too thick a particle will not adhere properly and will also tend to smear. The flattened shape of the mica gives greater adhesive force per unit of particle weight.

The powder is preferably an inorganic base powder which has reflective properties which are preserved by the method and the preparation of the present invention. The powder preferably has mica platelets of the above-mentioned dimensions coated with titanium dioxide and/or iron oxide to give is luster and reflectivity and includes PVP in order to assist in the adhesion to the applicator 1.

The powders should also include a bacteriostat and, preferably, a small percentage of uncoated mica platelets to extend the formulation without noticeably affecting the luster.

The following are examples of those powders which have operated satisfactorily:

EXAMPLE 3

Silver Colored Powder

| % by weight | Component |
|---|---|
| 10% | Nu Antique Silver - Timica Grade (Mearl Corp.) |
| 60% | Superpearl 100 - Flamenco Grade (Mearl Corp.) |
| 19.5% | Mica-Cosmetic Grade (Whittaker, Clark & Daniels) |
| 10% | PVP—K 30 (GAF Corp.) |
| .5% | Propylparaben (preservative-bacteriostat) |

EXAMPLE 4

Gold Colored Powder

| % by weight | Component |
|---|---|
| 18% | Superpearl 100 - Flamenco Grade (Mearl Corp.) |
| 15% | Golden Bronze - Cloissone Grade (Mearl Corp.) |
| 47% | Gold - Cloissone Grade (Mearl Corp.) |
| 9.5% | Mica-Cosmetic Grade (Whittaker, Clark & Daniels) |
| 10% | PVP—K 30 (GAF Corp.) |
| .5% | Propylparaben (preservative-bacteriostat) |

All of the components are dry blended for a period not more than 6 hours and not less than 2 hours. The PVP is withheld initially to ensure that all of the powders are properly blended. Once complete blending of the base powders is accomplished, the PVP is added with additional blending for at least 1 hour.

It will be appreciated that the instant specification and examples are set forth by way of illustration and not limitation, and that various modifications and changes may be made without departing from the spirit and scope of the present invention.

What is claimed is:

1. A cosmetic preparation comprising: a cosmetic powder comprising mica, titanium dioxide, PVP and a bacteriostat and implanted into a film of fixative on an area of the body by applying one of a liquid or gel fixative to the area, allowing the fixative to partially dry to form a film, applying the cosmetic powder to the partially dried fixative and allowing the fixative to completely dry, wherein the powder is maintained in position by a fixative and some particles project outwardly from the film and are thereby exposed.

2. The cosmetic preparation according to claim 1, wherein the powder is applied by an imprinting applicator having a planar contact surface in the form of a given design, contacting the cosmetic powder to the contact surface to adhere a layer of powder thereon and contacting the contact surface of the imprinting implement with the layer of powder thereon to the partially dried fixative to implant the powder in the film in the form of the given design.

3. The cosmetic preparation according to claim 2, wherein the liquid fixative is applied by dropping at least one individual droplet onto the area of the body and spreading the fixative to encompass the total area to which the cosmetic is to be applied.

4. The cosmetic preparation according to claim 1, wherein the liquid fixative comprises water, resin, plasticizer, fragrance, an emulsifying agent for the fragrance, a bacteriostat and a dye.

5. The cosmetic preparation according to claim 1, wherein the powder comprises particles having a thickness of about 1 μm and a length of about 5–50 μm.

* * * * *